United States Patent [19]

Rohmfeld

[11] Patent Number: 5,046,186

[45] Date of Patent: Sep. 3, 1991

[54] ROTATING X-RAY TUBE

[75] Inventor: Josef Rohmfeld, Erlangen, Fed. Rep. of Germany

[73] Assignee: Siemens Aktiengesellschaft, Munich, Fed. Rep. of Germany

[21] Appl. No.: 600,680

[22] Filed: Oct. 22, 1990

[30] Foreign Application Priority Data

Feb. 9, 1990 [DE] Fed. Rep. of Germany ..... 4004013

[51] Int. Cl.[5] ..... H01J 35/10

[52] U.S. Cl. ..... 378/125; 378/121

[58] Field of Search ..... 378/125-133

[56] References Cited

U.S. PATENT DOCUMENTS 4,788,705 11/1988 Anderson ..... 378/125

4,878,235 10/1989 Anderson ..... 378/125

FOREIGN PATENT DOCUMENTS 1614785 12/1970 Fed. Rep. of Germany .

*Primary Examiner*—Craig E. Church

*Attorney, Agent, or Firm*—Hill, Van Santen, Steadman & Simpson

[57] ABSTRACT

A rotating x-ray tube has a vacuum housing provided with central shafts at both sides, which are rotatably held in bearings connected to a radiator housing. An anode is rigidly mounted to the vacuum housing, and a cathode arrangement, having an eccentrically disposed cathode, is mounted on one of the shafts. The shaft supporting the cathode arrangement is hollow, and a filament transformer is disposed on the hollow shaft. A further shaft, which is rigidly connected to the cathode arrangement, is conducted through the hollow shaft. The cathode arrangement and/or the interior shaft are rotatably connected to the hollow shaft. The secondary coil of the filament transformer, which is connected to the glow helices of the cathode arrangement, is mounted on the interior shaft.

6 Claims, 1 Drawing Sheet

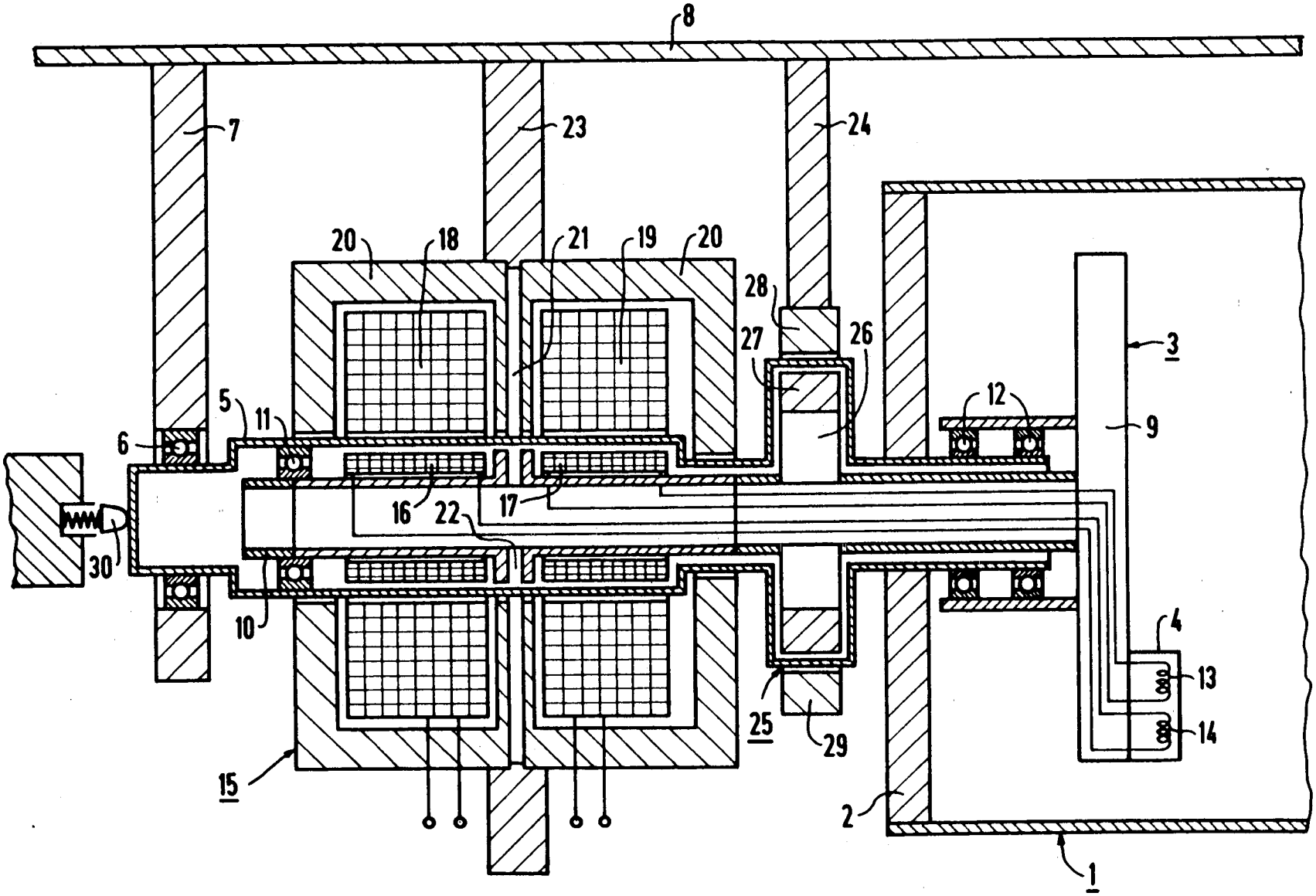
1
2
3
4
5
6
7
8
9
10
11
12
13
14
15
16
17
18
19
20
21
22
23
24
25
26
27
28
29
30

ROTATING X-RAY TUBE

BACKGROUND OF THE INVENTION

1. Field of the Invention

The present invention is directed to a rotating x-ray tube having a vacuum housing with central shafts at both sides thereof, rotatably held in bearings connected to a radiator housing, and an anode rigidly connected to the vacuum housing, with a cathode arrangement mounted on a shaft attached at one side of the vacuum housing.

2. Description of the Prior Art

A rotating x-ray tube is disclosed in German OS 16 14 785 wherein the secondary coil of a filament transformer is rigidly attached to a shaft on which the cathode is mounted. The filament transformer is electrically connected to the glow (emission) helix of the cathode. The primary coil of the filament transformer concentrically surrrounds the rotating shaft, and is stationary. The shaft on which the secondary coil is mounted is rigidly joined to the rotating shaft. A disadvantage of this known structure is that the necessary connection of the glow cathode to ground must take place via a radial wiper contact, with the magnetic stray flux from this contact arrangement being extremely high.

Additionally, in this known structure it is not possible to operate two glow helices in alternation, as has now become preferable in many instances, because a separation of the magnetic circuits is extremely difficult to achieve in the known structure. Moreover, this known structure cannot be used given stationary cathodes, without inner wiper contacts being provided.

SUMMARY OF THE INVENTION

It is an object of the present invention to provide a rotating x-ray tube of the type described above which permits the use of an eccentrically disposed cathode, and wherein transmission of the heating current for the glow helices can be achieved with high efficiency.

The above object is achieved in accordance with the principles of the present invention in a rotating x-ray tube, wherein the shaft at the cathode side of the tube is hollow, and a further shaft, rigidly joined to a cathode arrangement, is conducted through the hollow shaft. The cathode of the cathode arrangement is eccentrically disposed. The cathode arrangement and/or the interior shaft are rotatably connected to the hollow shaft. The secondary coil of the filament transformer, which is connected to the glow helix or helices of the cathode arrangement is secured to the interior shaft. This arrangement results in a cathode which can operate without magnetic deflection of the electron beam.

A tighter magnetic coupling is achieved in an embodiment wherein the primary coil concentrically surrounds the secondary coil of the filament transformer. Two glow helices can be provided in the cathode arrangement, and can be separately driven by providing two secondary coils mounted on the interior shaft, each of these secondary coils being surrounded concentrically by a primary coil. One secondary coil is connected to one glow helix of the cathode arrangement, and the other secondary coil is connected to the other glow helix.

Closure of the magnetic circuit is further enhanced by constructing the interior shaft in the region of the filament transformer as a core consisting of a material having high electrical resistance and low magnetic reversal losses, for example ferrite, and by surrounding the filament transfomer with at least one ferrite shell. By using a magnetic coupling which surrounds the hollow shaft, a rigid locking of the eccentrically disposed cathode can be achieved without the electrons emanating from the cathode being influenced by the magnetic field.

DESCRIPTION OF THE DRAWINGS

The single FIGURE is a side sectional view of a portion of a rotating x-ray tube constructed in accordance with the principles of the present invention.

DESCRIPTION OF THE PREFERRED EMBODIMENTS

The components of a rotating anode x-ray tube necessary to explain the invention are shown in the drawing. The x-ray tube 1 includes a vacuum housing 2, only the cathode end of which is shown in the drawing. It will be understood the x-ray tube 1 also contains an anode rigidly connected to the vacuum housing 2 and electrical components associated therewith, at an opposite end of the x-ray tube 1 (not shown). A cathode arrangement 3, having an eccentrically disposed cathode 4, is siutated inside the vacuum housing 2. The rotationally symmetric vacuum housing 2 is provided with central shafts at both sides thereof, with only the shaft 5 disposed at the cathode side of the housing 2 being shown in the drawing. The shaft 5 is rotatably held by a carrier 7 via bearings 6, and is connected to a radiator housing 8.

The shaft 5 is rigidly connected to the vacuum housing 2, and is hollow. An interior shaft 10 is connected to a cathode carrier 9 of the cathode arrangement 3, and is received in the interior of the hollow shaft 5. The interior shaft 10 is held within the shaft 5 by ball bearings 11 and 12.

A filament transformer 15 is provided for supplying the glow helices 13 and 14 with heating current. The secondary coils 16 and 17 of this filament transformer 15 are rigidly mounted on the interior shaft 10, and are respectively electrically connected to the glow helices 13 and 14. The secondary coils 16 and 17 are concentrically surrounded by the primary coils 18 and 19 of the filament transformer 15. The wall of the hollow shaft 5 rotates in the air gap between the primary coils 18 and 19 and the secondary coils 16 and 17. The interior shaft 10 is in the form of a core having high electrical resistance and low hysteresis losses in the region of the coils 15 through 19. The interior shaft 10 may consist, for example, of ferrite. The coils 15 through 19 are surrounded by a ferrite shell 20, which is held by a carrier 23 attached to the radiator housing 8. Air gaps 21 and 22 are provided between the primary coils 18 and 19 and the secondary coils 16 and 17 for magnetic separation of the two magnetic circuits of the transformer 15.

Because the vacuum housing and the anode connected thereto rotate, the cathode arrangement 3 must be retained in one position, so that the x-rays can emerge from the x-ray tube 1 in only one direction. This is achieved by a magnetic coupling 25, attached to the radiator housing 8 by a carrier 24. The magnetic coupling 25 consists of an inner coupling 26 attached to the interior shaft 10 and which is surrounded by the shaft 5, which has a larger diameter in this region. The inner coupling 26 has a plurality of permanent magnets 27 of alternating polarity, having outwardly directed magnetic flux. An outer coupling 28, which is also part of the magnetic coupling 25, has a plurality of permanent magnets 29, also arranged with alternating poles. The permanent magnets 27 and 29, which have opposite poles facing toward one another, attract. As a result, the interior shaft 10, and thus the cathode arrangement 3, are retained, but the x-ray tube 1 is free to rotate with the shaft 5.

Feed of the high voltage for the cathode arrangement 3 can be accomplished, for example, via a button contact 30 biased against the surface of the hollow shaft 5.

Although modifications and changes may be suggested by those skilled in the art, it is the intention of the inventor to embody within the patent warranted hereon all changes and modifications as reasonably and properly come within the scope of his contribution to the art.

I claim as my invention:

1. A rotating x-ray tube comprising:

a vacuum housing;

a rotationally mounted hollow shaft rigidly attached to said housing;

an interior shaft disposed inside said hollow shaft with said hollow shaft free to rotate, with said housing, around said interior shaft, said interior shaft having an end extending into said housing through said hollow shaft;

a cathode assembly disposed in said housing and mounted on said end of said interior shaft, said cathode assembly having a cathode eccentrically disposed thereon; and a filament transformer electrically connected to said cathode and having a secondary coil disposed in said hollow shaft and mounted on said interior shaft.

2. A rotating x-ray tube as claimed in claim 1 wherein said filament transformer has a primary coil concentrically surrounding said secondary coil, said primary coil disposed outside of said hollow shaft.

3. A rotating x-ray tube as claimed in claim 1 wherein said cathode consists of first and second glow helices, said first glow helix being connected to said secondary coil, and said rotating x-ray tube further comprising a further secondary coil disposed in said hollow shaft and mounted on said interior shaft spaced from said secondary coil, said second glow helix being electrically connected to said further secondary coil.

4. A rotating x-ray tube as claimed in claim 1 wherein said cathode shaft, at least in a region in registry with said secondary coil, consists of material having high electrical resistance and low hysteresis losses, and said rotating x-ray tube further comprising a ferrite shell surrounding said filament transformer.

5. A rotating x-ray tube as claimed in claim 1 further comprising:

magnetic coupling means for holding said cathode assembly in a stationary position while said hollow shaft and said housing rotate.

6. A rotating x-ray tube as claimed in claim 5 wherein said magnetic coupling means comprises an inner coupling part mounted on said interior shaft and/a stationary outer coupling part arranged in registry with said inner coupling part and surrounding said hollow shaft.

* * * * *